US008272099B2

(12) United States Patent
Tsuen-Heng et al.

(10) Patent No.: US 8,272,099 B2
(45) Date of Patent: Sep. 25, 2012

(54) ANTI-PINCH DEVICE FOR A DRAWER

(76) Inventors: Tsai Tsuen-Heng, Taichung (TW); Sh Hung-Sheng, Taichung (TW)

( * ) Notice: Subject to any disclaimer, the term of this patent is extended or adjusted under 35 U.S.C. 154(b) by 261 days.

(21) Appl. No.: 12/589,966

(22) Filed: Nov. 2, 2009

(65) Prior Publication Data

US 2010/0251515 A1 Oct. 7, 2010

(30) Foreign Application Priority Data

Apr. 2, 2009 (TW) ..... 98205266 U

(51) Int. Cl.
*E05F 5/02* (2006.01)

(52) U.S. Cl. ..... 16/82; 312/334.46

(58) Field of Classification Search ..... 16/82, 83, 16/85, 86 R, 86 A, DIG. 17, DIG. 21; 312/330.1, 312/334.44, 334.46
See application file for complete search history.

(56) References Cited

U.S. PATENT DOCUMENTS 2,826,474 A * 3/1958 Haydu ..... 312/334.46
3,639,028 A * 2/1972 Black ..... 312/334.46
5,740,585 A * 4/1998 Shapiro ..... 16/82
8,028,376 B2 * 10/2011 Karapetyan ..... 16/82

* cited by examiner

*Primary Examiner* — William L. Miller

(57) ABSTRACT

An anti-pinch device for a drawer comprises: a flexible anti-pinch body, an elastic deformable portion, a sliding portion, and a stop portion; wherein a lower horizontal section is a fixing end which is to be fixed to an inner bottom surface of the drawer, a longitudinal section of the anti-pinch body opposite the fixing end is an extending section on which is formed the elastic deformable portion, and the sliding portion is located above the extending section, one surface of the sliding portion opposite to the extending section is the stop portion, a distance between the sliding portion and the stop portion is larger than a diameter of user's finger, whereby, when the drawer is pulled open, the sliding portion and the stop portion spring up and extend out of the drawer, so as to prevent the user's finger from getting pinched if the drawer is closed accidently.

8 Claims, 12 Drawing Sheets

ANTI-PINCH DEVICE FOR A DRAWER

BACKGROUND OF THE INVENTION

1. Field of the Invention

The present invention relates to furniture, and more particularly to an anti-pinch device for a drawer.

2. Description of the Prior Art

Table and cupboard are mostly provided with drawers, and because of careless operation, user's fingers sometimes get pinched, which is a safety concern, especially for those innocent and curious children.

The present invention has arisen to mitigate and/or obviate the afore-described disadvantages.

SUMMARY OF THE INVENTION

The primary object of the present invention is to provide an anti-pinch device for a drawer, wherein an anti-pinch body is disposed at the inner end surface of a drawer, after the drawer is pulled open, the sliding portion and the stop portion spring up automatically and extend out of the drawer, so as to prevent the user's finger from getting pinched if the drawer is closed accidently.

To achieve the above object, an anti-pinch device for a drawer provided in accordance with the present invention comprises: a flexible anti-pinch body with a fixing end to be fixed to inside of a drawer, an elastic deformable portion with an elastic restoring force extending from the fixing end, and a sliding portion with a predetermined width being formed on the elastic deformable portion. One end of the sliding portion is formed a stop portion capable of preventing the drawer from being closed, a horizontal width between the sliding portion and the stop portion is larger than a diameter of user's finger, whereby, when the drawer is pulled open, the sliding portion and the stop portion spring up and extend out of the drawer, so as to prevent the user's finger from getting pinched if the drawer is closed accidently.

To achieve the above object, an anti-pinch device for a drawer provided in accordance with another embodiment of the present invention comprises: a flexible anti-pinch body, an elastic deformable portion, a sliding portion, and a stop portion; wherein a lower horizontal section is a fixing end which is to be fixed to an inner bottom surface of the drawer, a longitudinal section of the anti-pinch body opposite to the fixing end is an extending section on which is formed the elastic deformable portion, and the sliding portion is located above the extending section, one surface of the sliding portion opposite to the extending section is the stop portion, a distance between the sliding portion and the stop portion is larger than a diameter of user's finger, whereby, when the drawer is pulled open, the sliding portion and the stop portion spring up and extend out of the drawer, so as to prevent the user's finger from getting pinched if the drawer is closed accidently.

With the abovementioned arrangements, the present invention has the following advantages:

First, the anti-pinch body is disposed inside the drawer, the sliding portion and the stop portion of the anti-pinch body form a width which is larger than the diameter of the user's finger, plus the elastic deformable portion is arranged in the middle of the anti-pinch body, the drawer can be closed easily by bending the anti-pinch body to its bent position where the sliding portion and the stop portion are lower than the top inner surface and can enter the drawer, and then the drawer can be pushed back into the drawer-receiving space to a closed position. Once the drawer is opened, the sliding portion and the stop portion spring up back to the stand-up position automatically and stand between the inner end surface of the drawer and the outer surface of the drawer-receiving space, even the drawer is accidently pushed back at this moment, the anti-pinch body can still prevent the user's finger getting pinched.

Second, the anti-pinch body can be L-shaped or reversely L-shaped.

Third, once the drawer is open, the anti-pinch body will be exposed out of the drawer, which reminds the user to close the drawer or not to put hand in between the drawer, in this case, the anti-pinch device provides a sort of warning function.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
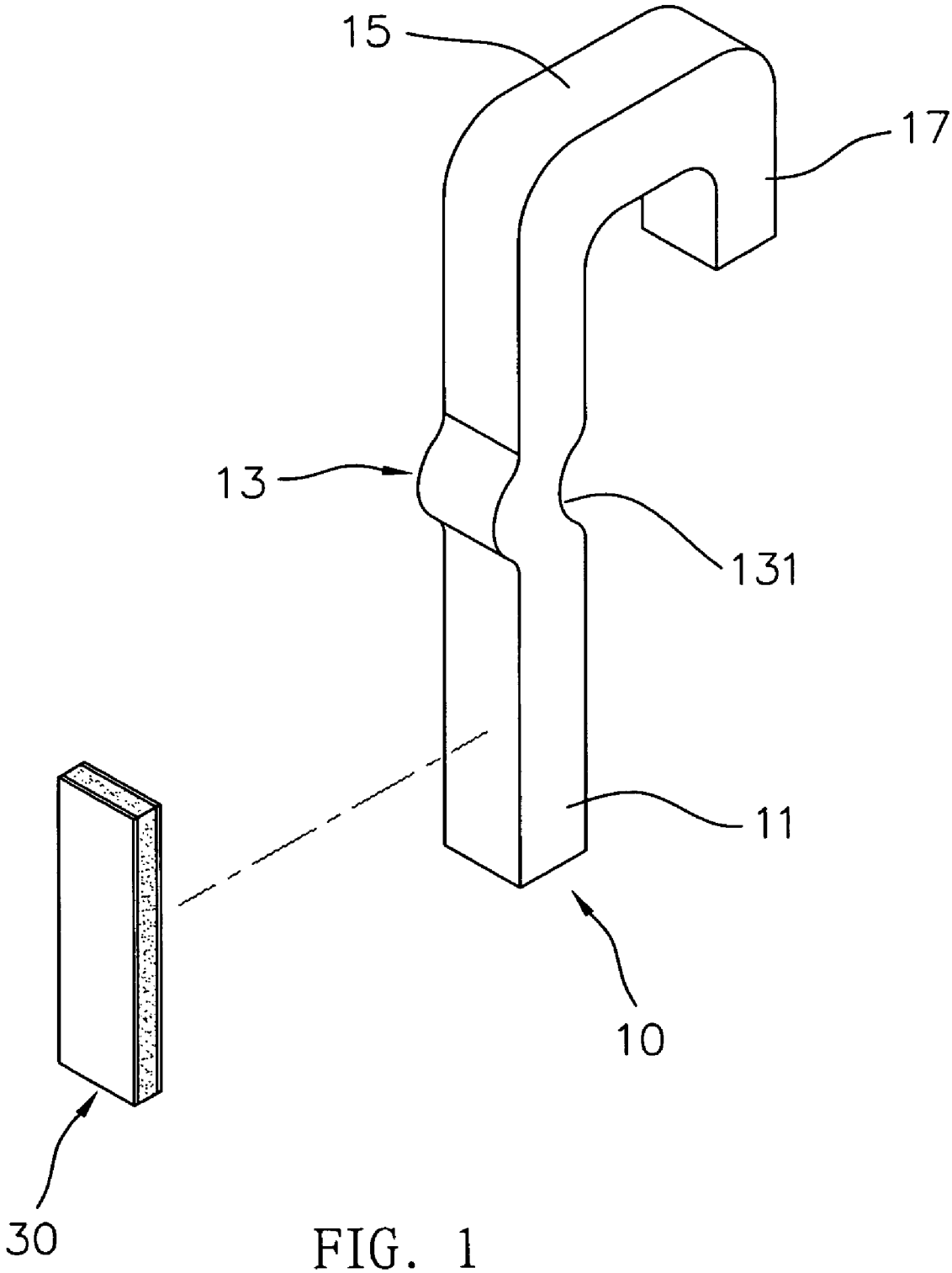
FIG. 1 is an exploded view of an anti-pinch device for a drawer in accordance with a first embodiment of the present invention.

Referring to FIG. 1, an anti-pinch device in accordance with the present invention comprises an anti-pinch body 10 and a fixing member 30. The anti-pinch body 10 is approximately L-shaped and includes a fixed end 11, an elastic deformable portion 13, a sliding portion 15 and a stop portion 17.

The fixed end 11 is the longitudinal end of the anti-pinch body 10, and the elastic deformable portion 13 is located on the fixed end 11. In an inner surface of the elastic deformable portion 13 is defined a dent 131 for enabling the elastic deformable portion 13 to be bendable. Located above the elastic deformable portion 13 is the sliding portion 15 which is a reversed L-shaped structure with a horizontal width. The stop portion 17 is at the end of the sliding portion 15 and located toward the fixed end 11. The horizontal width from the sliding portion 15 to the stop portion 17 is larger than the diameter of fingers. The fixing member 30 can be double adhesive tape to fix the anti-pinch body 10 to the inner end of a drawer.

Figure 2:
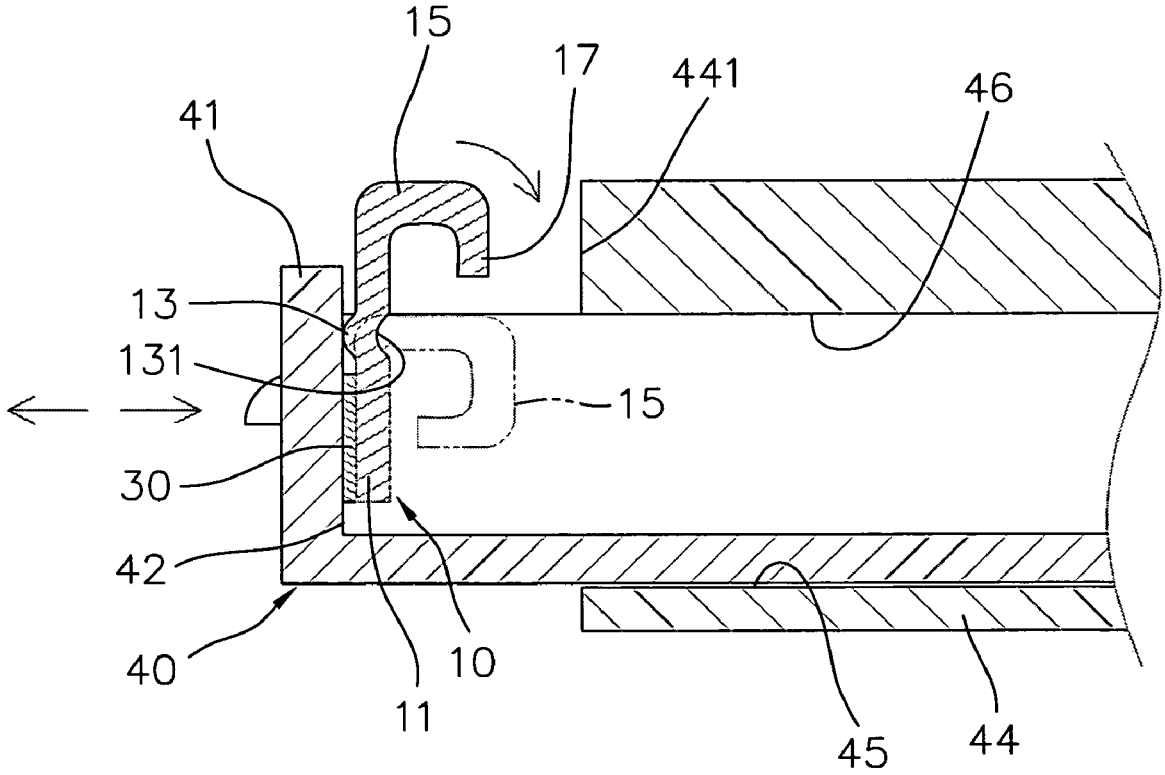
FIG. 2 is an operational view of the anti-pinch device for a drawer in accordance with the first embodiment of the present invention.
Figure 3:
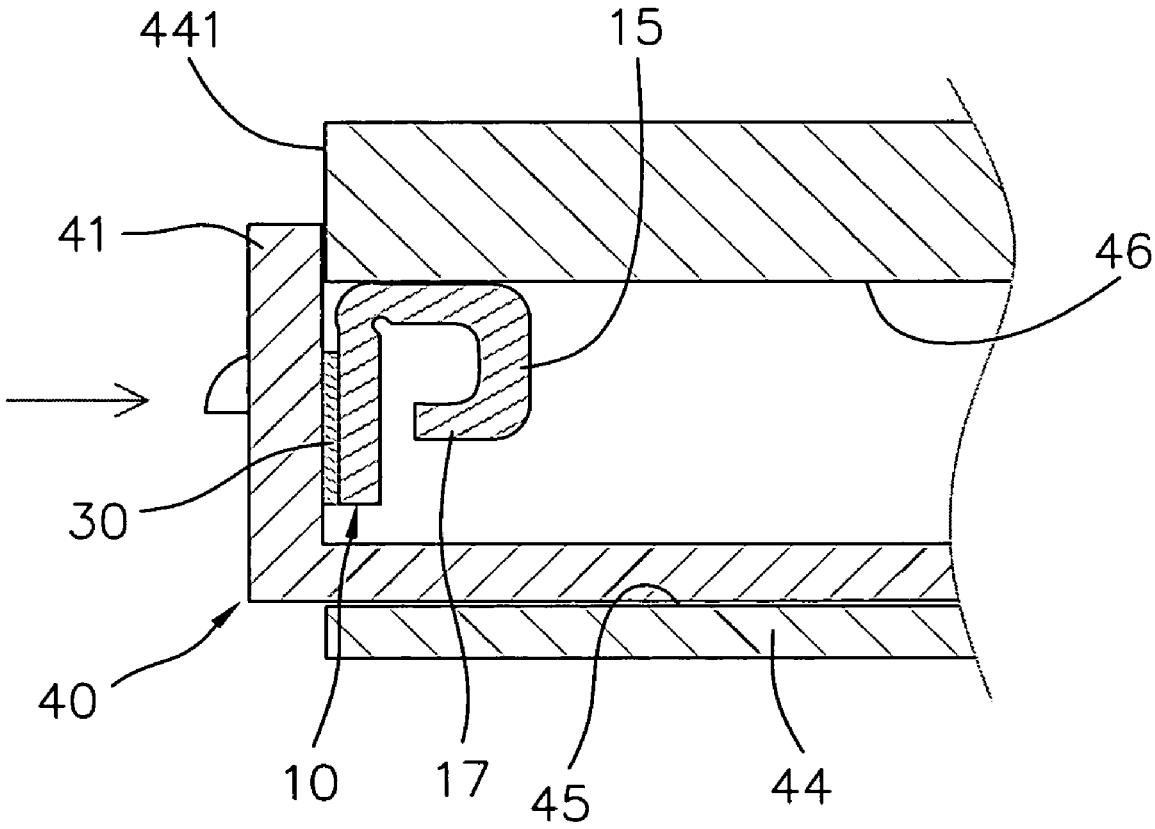
FIG. 3 shows the status of the anti-pinch device of the first embodiment of the present invention when the drawer is closed.

Referring then to FIGS. 2 and 3, which show the relation between the anti-pinch body 10 and the drawer 40, wherein a furniture piece 44, such as desk or cupboard, is provided with a drawer-receiving space 45 for accommodation of the drawer 40. The drawer 40 includes an end board 41 for closing the drawer-receiving space 45, and the end board 41 has an inner surface 42. Located above the drawer-receiving space 45 is a top inner surface 46 of the drawer-receiving space 45.

The fixed end 11 of the anti-pinch body 10 is fixed to the inner surface 42 of the drawer 40 by the fixing member 30 in such a manner the sliding portion 15 and the stop portion 17, when in a stand-up position, are higher than the top inner surface 46 of the drawer-receiving space 45, and the stop portion 17 faces toward an outer surface of the drawer-receiving space 45. To close the drawer 40, the anti-pinch body 10 can be bent downward about the dent 131 of the elastic deformable portion 13 until the sliding portion 15 and the stop portion 17 are lower than the top inner surface 46, and then the drawer 40 is pushed with the sliding portion 15 sliding along the top inner surface 46 until the end board 41 abuts against the outer surface 441, and thus the drawer 40 is closed. The sliding portion 15 preferably has a smooth surface for facilitating its sliding movement along the top inner surface 46.

Figure 4:
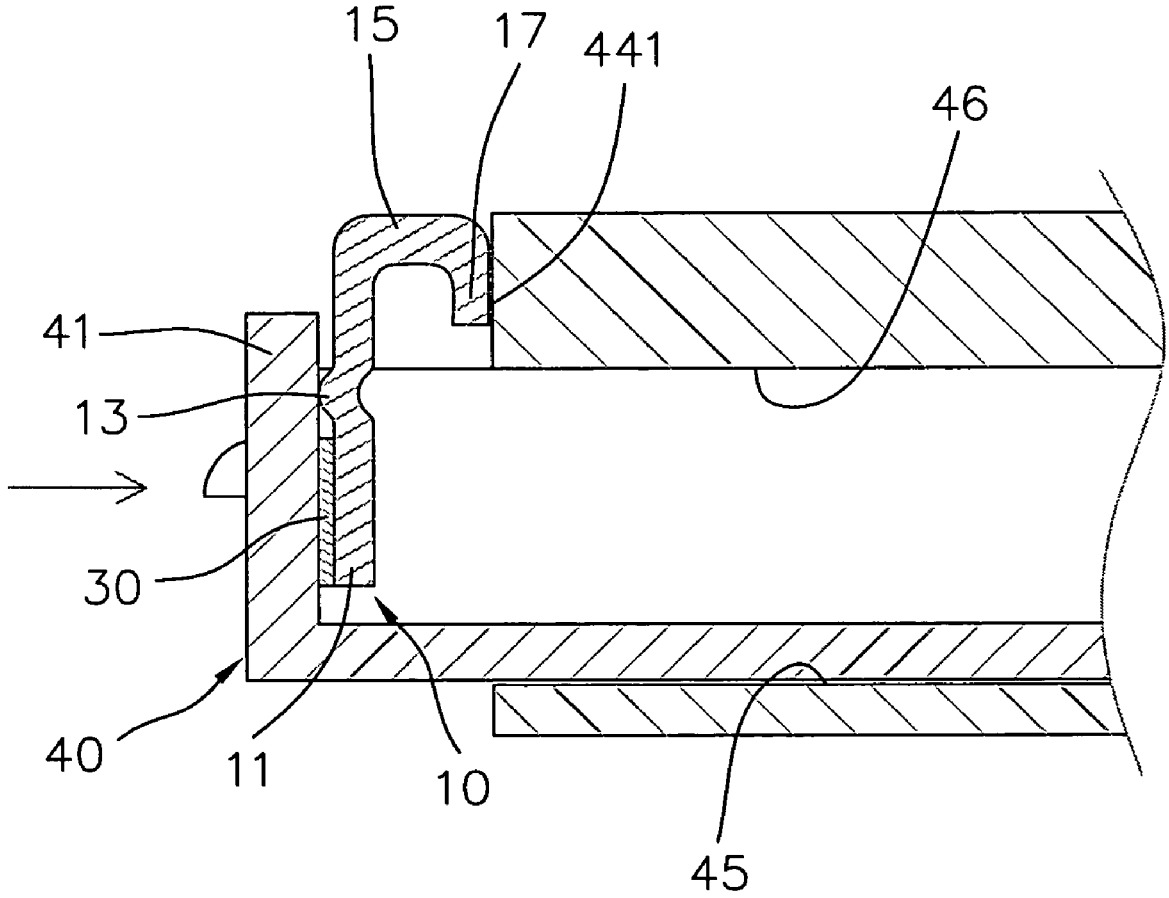
FIG. 4 shows the anti-pinch status of the anti-pinch device of the first embodiment of the present invention.

The anti-pinch effect of the present invention is illustrated in FIGS. 2 and 4, simply by pulling the drawer 40 away from the drawer-receiving space 45, the anti-pinch body 10 will not be stopped by the top inner surface 46 anymore and will be returned by its elasticity to the stand-up position again where the sliding portion and the stop portion 17 extend out of the end board 41 of the drawer 40 and stand between the end board 41 and the outer surface 441 of the furniture piece 44.

If the user's finger enters the drawer 40 and stops between the inner end surface 42 of the drawer 40 and the outer surface 441 of the drawer-receiving space 45, and the drawer 40 is unintentionally pushed toward the drawer-receiving space 45, since the anti-pinch body 10 is located between the inner end surface 42 of the drawer 40 and the outer surface 441 of the drawer-receiving space 45, plus the design that the width of the sliding portion 15 and the stop portion 17 is larger than the diameter of the user's finger, the stop portion 17 of the anti-pinch body 10 will be stopped against the outer surface 441 of the drawer-receiving space 45, so that the interval between the drawer 40 and the outer surface 441 of the drawer-receiving space 45 is controlled to be larger than the finger, and thus preventing finger from getting pinched by the inner end surface 42 of the drawer 40 and the outer surface 441 of the drawer-receiving space 45. Furthermore, since the anti-pinch body 10 is exposed out of the end board 41 of the drawer 40 to stop the closing of the drawer 40, which reminds the user to pull out hand safely. To close the drawer 40, the anti-pinch body 10 can be bent again to its bent position where the sliding portion 15 and the stop portion 17 are lower than the top inner surface 46 and can enter the drawer 40, and then the drawer 40 can be pushed back into the drawer-receiving space 45 to a closed position.

Referring then to FIGS. 5-8, an anti-pinch body 101 in accordance with a second embodiment of the present invention is L-shaped and its lower horizontal section is a fixing end 111 which is to be adhered to the inner bottom surface 43 of the drawer 40 by the fixing member 30. The longitudinal section of the anti-pinch body 101 is a straight extending section 12 on which are formed a plurality of horizontal grooves so as to form an elastic deformable portion 132, and a sliding portion 15 above the extending section 12. The surface of the sliding portion 151 of the extending section 12 facing the drawer-receiving space 45 is a stop portion 171 whose thickness is at least larger than diameter of user's finger. Likewise, the elastic deformable portion 132 is bent down to a position where the anti-pinch body 101 is within the scope of the drawer 40 and lower than the drawer-receiving space 46, allowing the drawer 40 to be closed.

Once the drawer 40 is opened, the extending section 12 and the stop portion 171 return back to the stand-up position and stand between the inner end surface 42 of the drawer 40 and the outer surface 441 of the drawer-receiving space 45, creating an anti-pinch effect.

Referring then to FIGS. 9-12, an anti-pinch body 102 in accordance with a second embodiment of the present invention is approximately L-shaped and its lower horizontal section is a fixing end 111 which is to be adhered to the inner bottom surface 43 of the drawer 40 by a fixing member 301. The longitudinal section of the anti-pinch body 101 is an arc-shaped extending section 121 on which are formed a plurality of horizontal grooves so as to form an elastic deformable portion 133, and an arc-shaped sliding portion 152 above the extending section 121. From the end of the sliding portion 152 facing the drawer-receiving space 45 is vertically extended a stop portion 172, the width between the extending section 121 and the stop portion 172 is at least larger than the user' finger. When the elastic deformable portion 133 is bent down to a position where the anti-pinch body 102 is within the scope of the drawer 40 and lower than the drawer-receiving space 46, allowing the drawer 40 to be closed. Once the drawer 40 is opened, the sliding portion 152 and the stop portion 172 spring up back to the stand-up position and stand between the inner end surface 42 of the drawer 40 and the outer surface 441 of the drawer-receiving space 45, even the drawer 40 is accidently pushed back at this moment, the anti-pinch body 102 can still prevent the user's finger from getting pinched.

Figure 5:
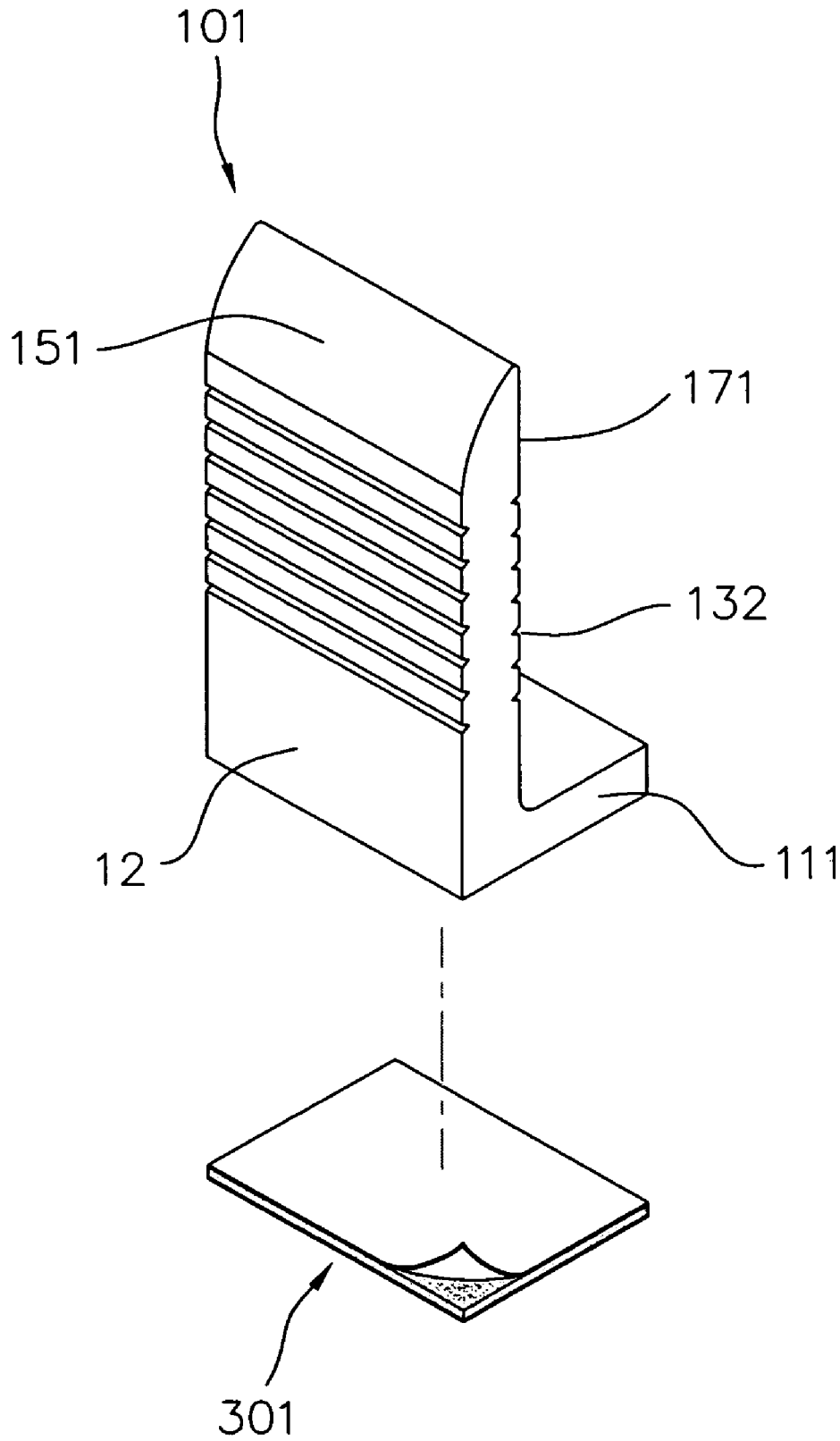
FIG. 5 is an exploded view of an anti-pinch device for a drawer in accordance with a second embodiment of the present invention.
Figure 6:
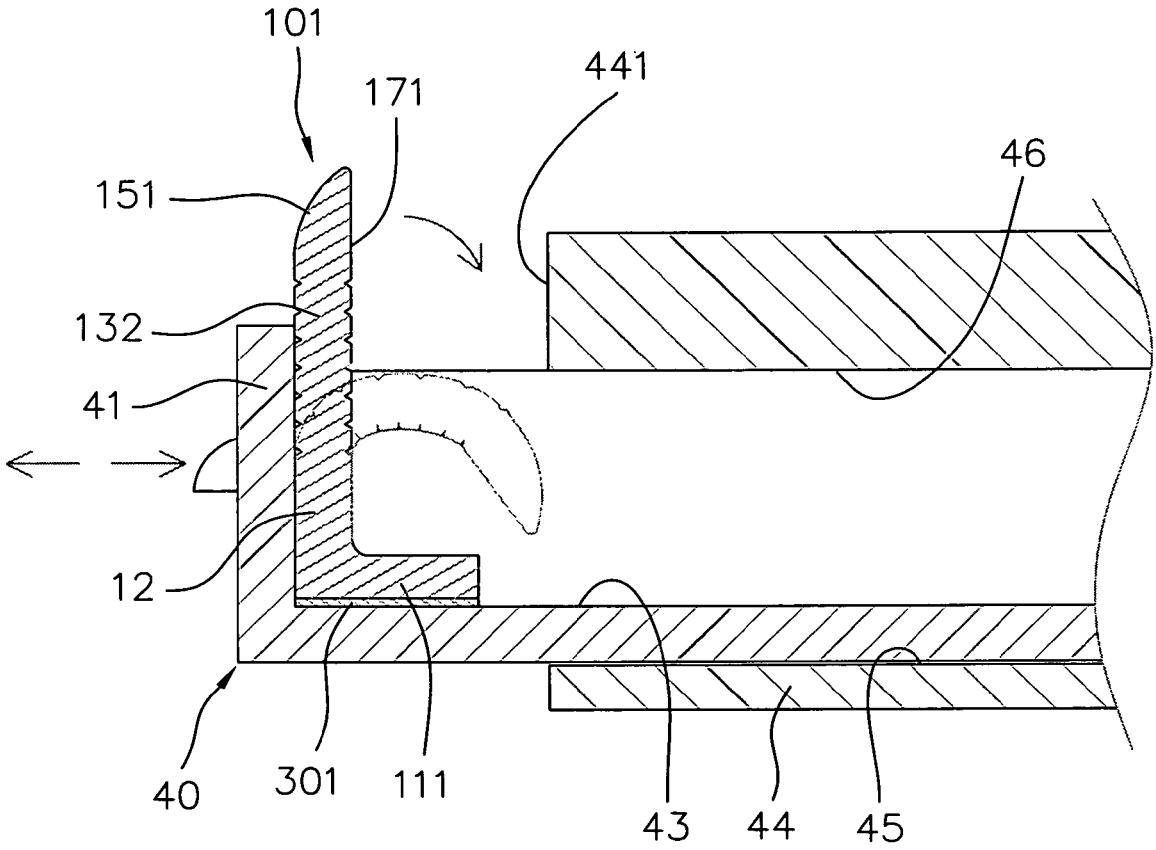
FIG. 6 is an operational view of the anti-pinch device for a drawer in accordance with the second embodiment of the present invention.
Figure 7:
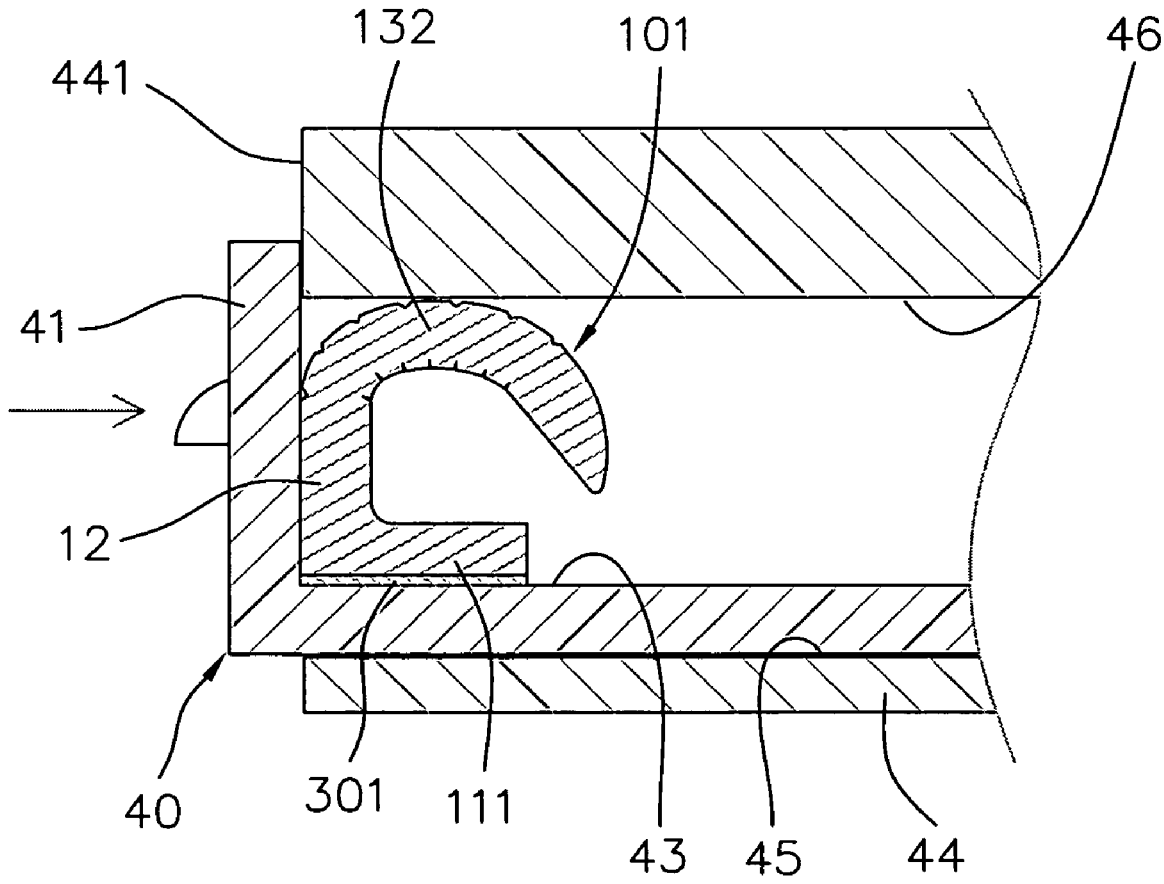
FIG. 7 shows the status of the anti-pinch device of the second embodiment of the present invention when the drawer is closed.
Figure 8:
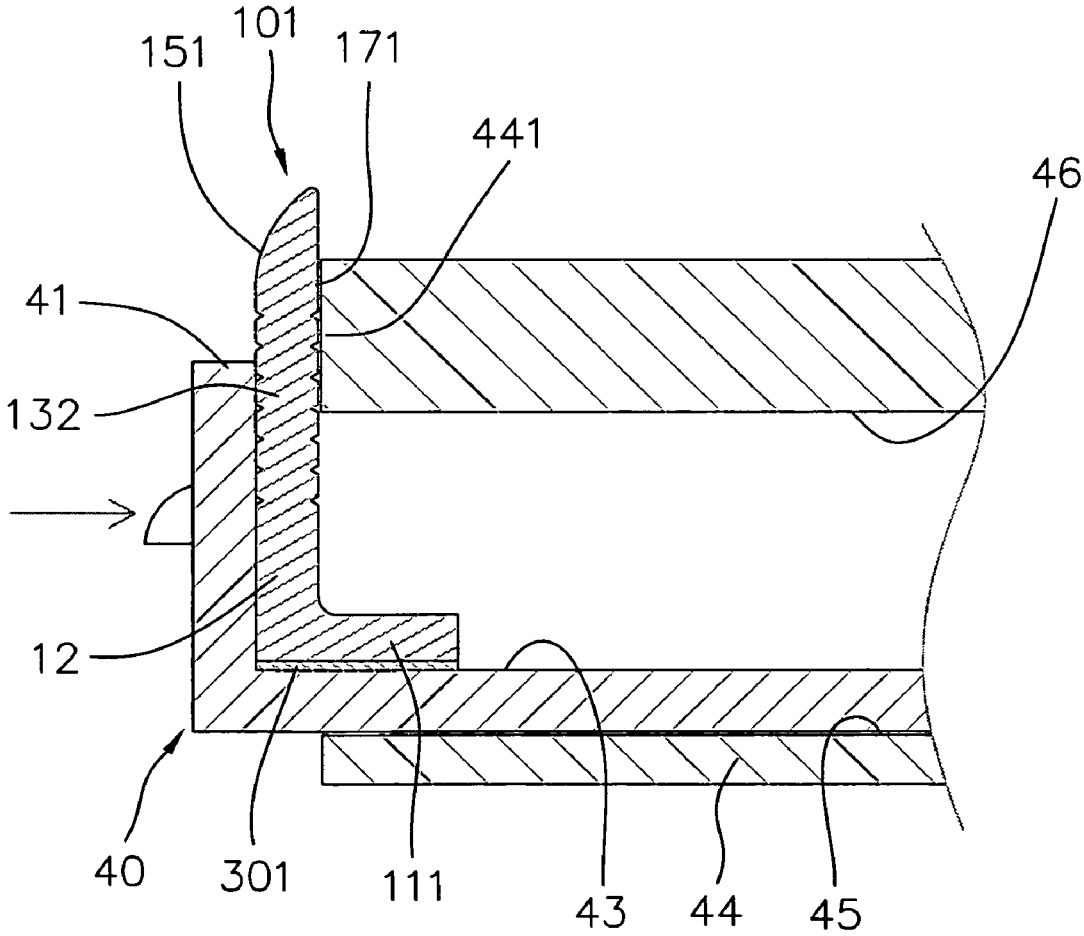
FIG. 8 shows the anti-pinch status of the anti-pinch device of the second embodiment of the present invention.
Figure 9:
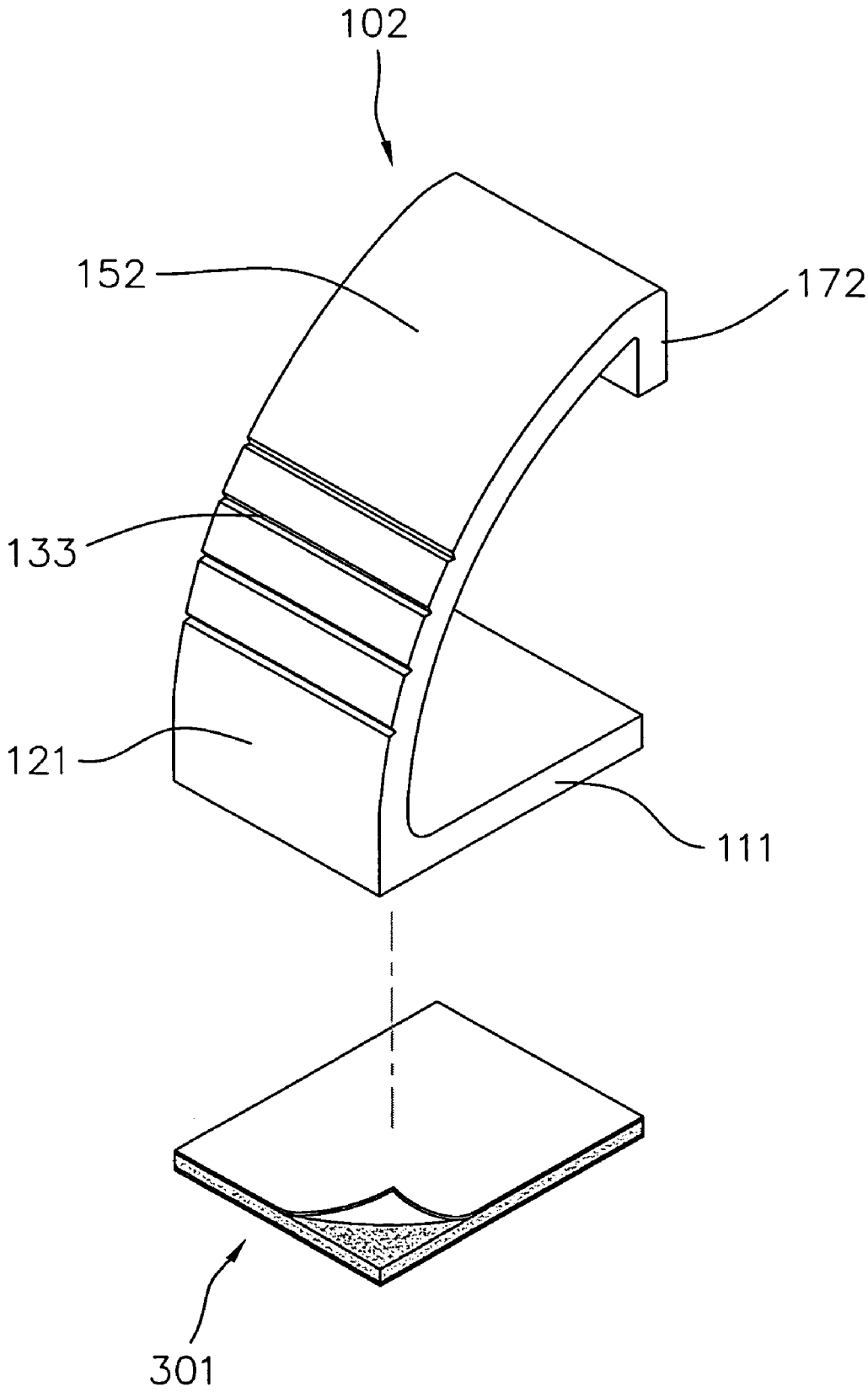
FIG. 9 is an exploded view of an anti-pinch device for a drawer in accordance with a third embodiment of the present invention.
Figure 10:
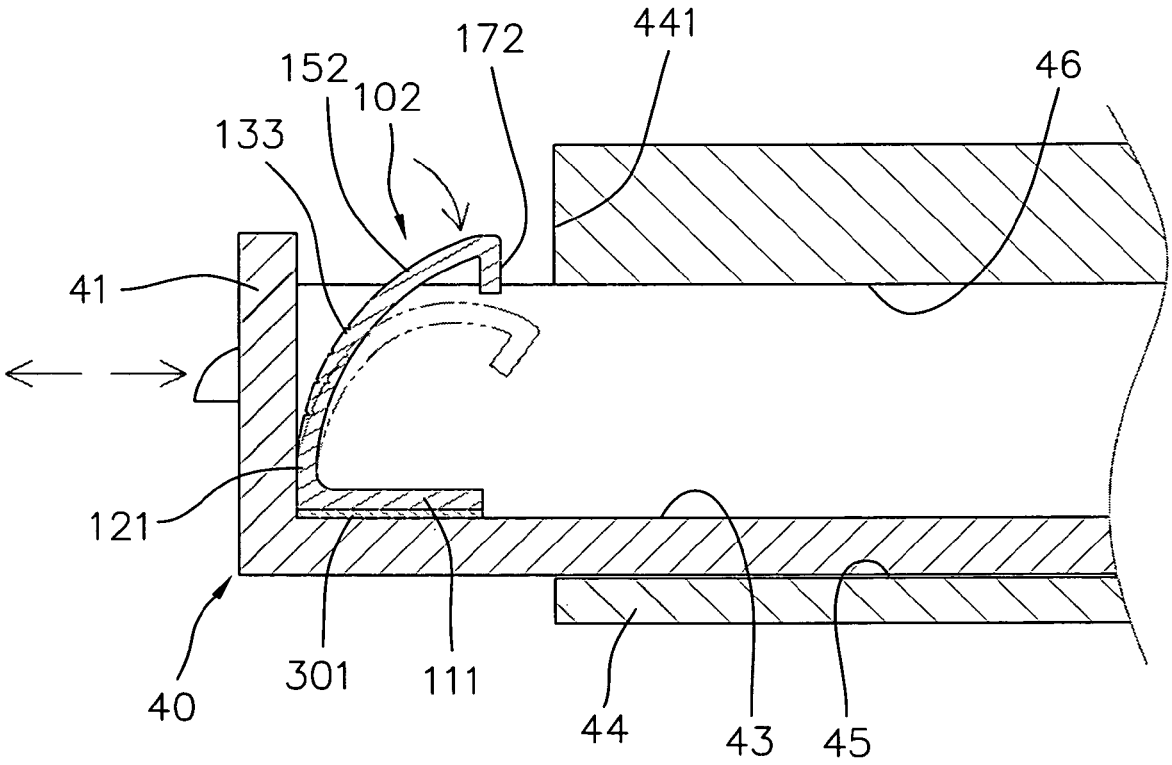
FIG. 10 is an operational view of the anti-pinch device for a drawer in accordance with the third embodiment of the present invention.
Figure 11:
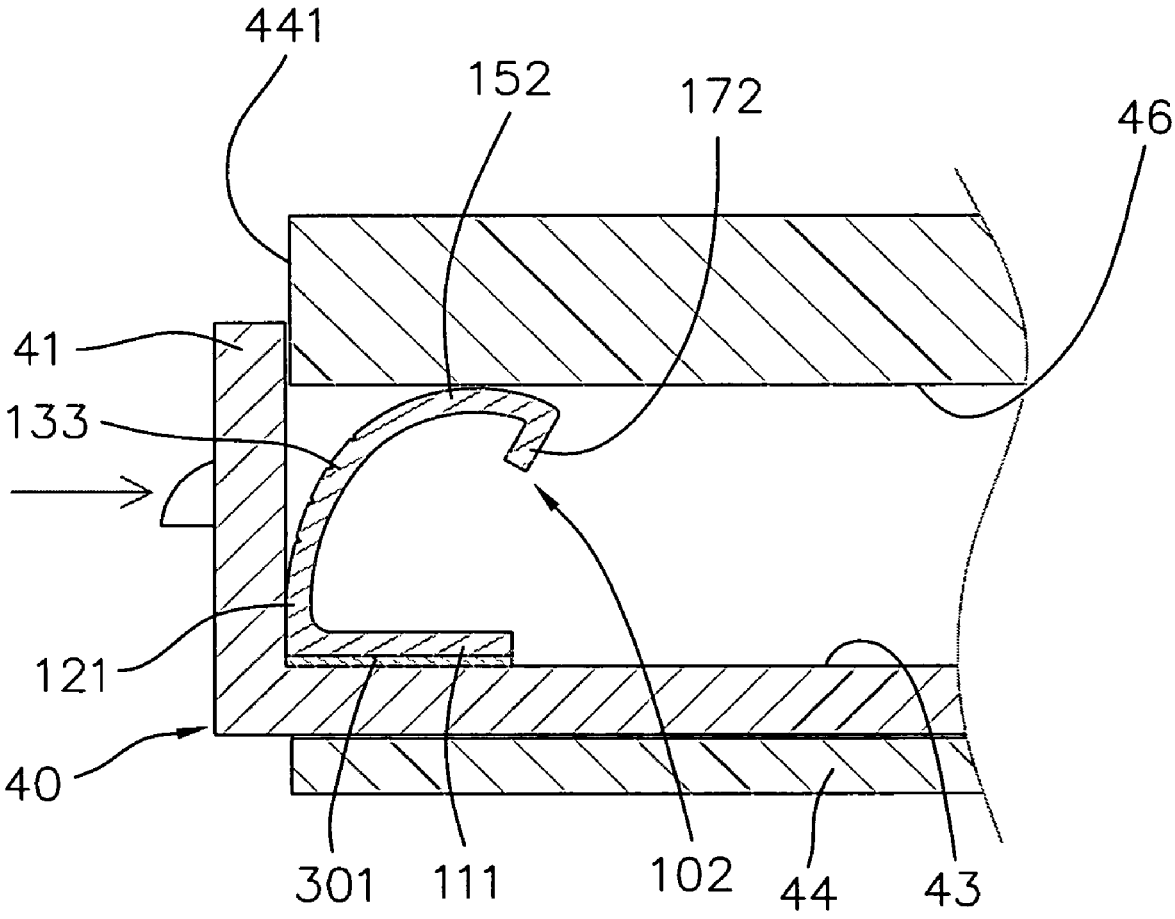
FIG. 11 shows the status of the anti-pinch device of the third embodiment of the present invention when the drawer is closed.
Figure 12:
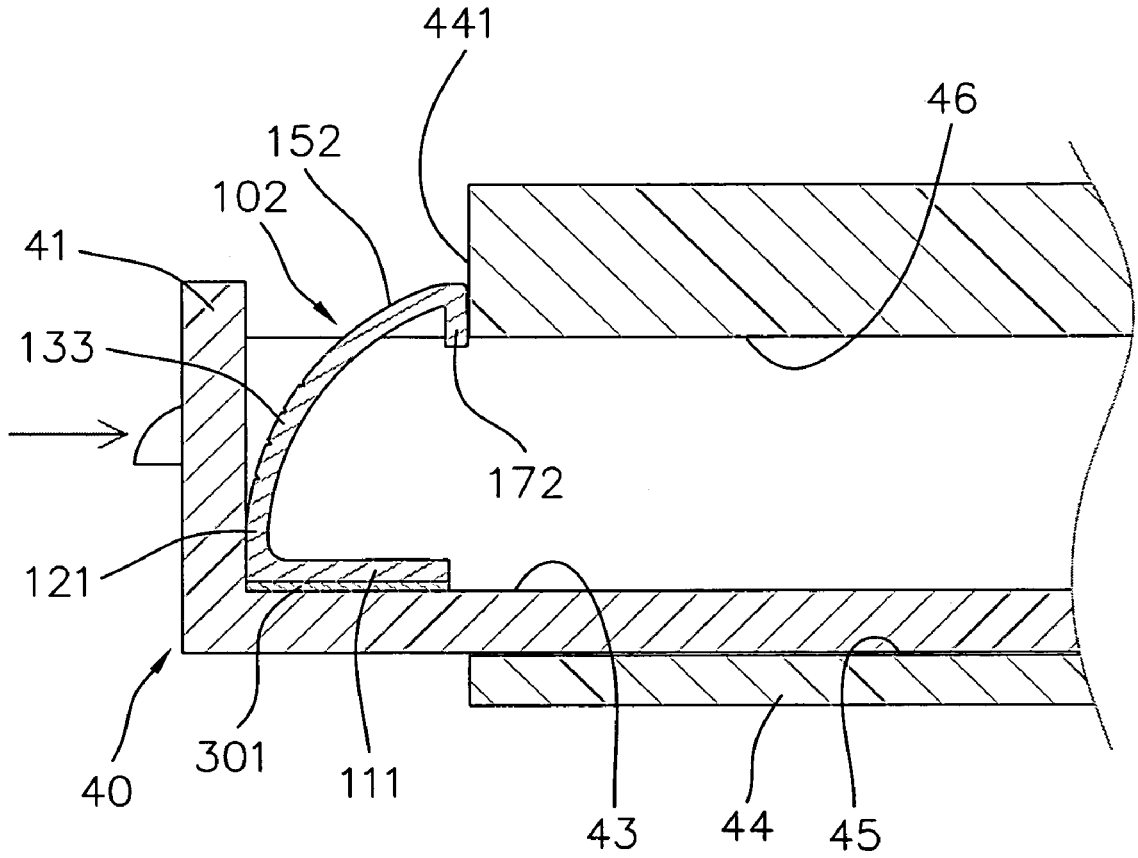
FIG. 12 shows the anti-pinch status of the anti-pinch device of the third embodiment of the present invention.

Moreover, the anti-pinch bodies 10, 101 and 102 shown in FIGS. 1, 5 and 9 can be treated with fluorescent or luminescent powder, so that it can be found even at night if the drawer 40 is not closed and then it can be closed in time.

While we have shown and described various embodiments in accordance with the present invention, it is clear to those skilled in the art that further embodiments may be made without departing from the scope of the present invention.

What is claimed is:

1. An anti-pinch device for a drawer comprising:

a flexible anti-pinch body with a fixing end fixed to an inner end surface of a drawer, an elastic deformable portion with an elastic restoring force extending from the fixing end, a sliding portion with a predetermined width being formed above the elastic deformable portion, and a stop portion being formed on an end of the sliding portion opposite to the elastic deformable portion such that the stop portion is capable of preventing the drawer from being closed, a horizontal width between the sliding portion and the stop portion configured to be larger than a diameter of user's finger, whereby, when the drawer is pulled open, the sliding portion and the stop portion spring up and extend out of the drawer, so as to prevent the user's finger from getting pinched if the drawer is closed accidently.

2. The anti-pinch device for a drawer as claimed in claim 1, wherein the fixing end of the anti-pinch body is adhered to the inner end surface of the drawer by a fixing member.

3. The anti-pinch device for a drawer as claimed in claim 1, wherein the elastic deformable portion is provided with grooves for improving its flexibility.

4. The anti-pinch device for a drawer as claimed in claim 1, wherein the sliding portion is a reversed L-shaped structure.

5. An anti-pinch device for a drawer comprising:

a flexible anti-pinch body with a lower horizontal section and a longitudinal section extending generally vertically therefrom, the lower horizontal section is a fixing end which is fixed to an inner bottom surface of the drawer, the longitudinal section of the anti-pinch body includes an extending section on which is formed an elastic deformable portion, a sliding portion located above the extending section, and a stop portion formed at an end of the sliding portion opposite to the extending section, wherein a distance between the sliding portion and the stop portion is configured to be larger than a diameter of user's finger, whereby, when the drawer is pulled open, the sliding portion and the stop portion spring up and extend out of the drawer, so as to prevent the user's finger from getting pinched if the drawer is closed accidently.

6. The anti-pinch device for a drawer as claimed in claim 5, wherein the anti-pinch body is L-shaped, the extending section is straight, the sliding portion is arc-shaped, the stop portion has a thickness configured to be greater than the user's finger, and the elastic deformable portion is provided with a plurality of horizontal grooves.

7. The anti-pinch device for a drawer as claimed in claim 5, wherein the extending section is arch-shaped and extends longitudinally, a plurality of horizontal grooves are provided on the elastic deformable portion, the sliding portion is arc-shaped, and the stop portion is vertically extending from the end of the sliding portion opposite to the extending section and facing a drawer-receiving space of the drawer, a width between the sliding portion and the stop portion configured to be larger than a diameter of the user's finger.

8. The anti-pinch device for a drawer as claimed in claim 5, wherein the fixing end is adhered to the inner bottom surface of the drawer by a fixing member.

* * * * *